US005197579A

United States Patent [19]

Bieber et al.

[11] Patent Number: 5,197,579

[45] Date of Patent: Mar. 30, 1993

[54] LUGGAGE WITH PULL HANDLE

[75] Inventors: David Bieber, East Greenwich, R.I.; Shaumin Liu, Portsmouth, Va.

[73] Assignee: American Tourister, Inc., Batesville, Ind.

[21] Appl. No.: 692,593

[22] Filed: Apr. 29, 1991

Related U.S. Application Data

[63] Continuation-in-part of Ser. No. 487,459, Mar. 2, 1990, Pat. No. 5,048,649.

[51] Int. Cl.[5] ..... A45C 5/14; A45C 13/26

[52] U.S. Cl. ..... 190/18 A; 190/115; 280/37

[58] Field of Search ..... 190/18 A, 115, 18 R; 280/37, 47, 371

[56] References Cited

U.S. PATENT DOCUMENTS

| | | | |
|---|---|---|---|
| 1,028,178 | 6/1912 | Batchelor | 190/18 A X |
| 1,413,852 | 4/1922 | Hokkanen | 190/18 A X |
| 1,895,677 | 1/1933 | Pinheiro | 190/18 A |
| 2,002,836 | 5/1935 | Rossi | 190/18 A X |
| 2,392,926 | 1/1946 | Kelly | 190/18 A X |
| 2,437,029 | 3/1948 | Howard | 280/DIG. 3 X |
| 2,510,754 | 6/1950 | Norlin | 190/18 A |
| 2,581,417 | 1/1952 | Jones | 190/18 A X |
| 2,596,578 | 5/1952 | McIntyre et al. | 190/18 A X |
| 3,522,955 | 8/1970 | Warner, Jr. | 190/18 A X |
| 3,526,921 | 9/1970 | Aupke | 190/18 A X |
| 3,606,372 | 9/1971 | Browning | 190/18 A X |
| 3,655,215 | 4/1972 | Becklin | 190/18 A X |
| 3,799,568 | 3/1974 | Hager | 190/18 A X |
| 3,879,798 | 4/1975 | Krulwich | 190/18 A X |
| 3,917,038 | 11/1975 | Foge et al. | 190/18 A |
| 3,987,875 | 10/1976 | Szabo | 190/18 A |
| 3,989,128 | 11/1976 | Walker | 190/18 A |
| 3,997,038 | 12/1976 | Walker | 190/18 A |
| 4,030,768 | 6/1977 | Lugash | 190/18 A X |
| 4,062,429 | 12/1977 | Tabor et al. | 190/18 A |
| 4,244,452 | 1/1981 | Seynhaeve | 190/18 A |
| 4,299,313 | 11/1981 | Null | 190/115 X |
| 4,358,005 | 11/1982 | Fontana | 190/18 A |
| 4,358,006 | 11/1982 | Castelli | 190/18 A |
| 4,411,343 | 10/1983 | Cassimally et al. | 190/115 X |
| 4,422,212 | 12/1983 | Sheiman | 190/18 A X |
| 4,508,202 | 4/1985 | Siegert et al. | 190/18 A X |
| 4,538,709 | 9/1985 | Williams et al. | 190/18 A |
| 4,561,526 | 12/1985 | Winter et al. | 190/18 A X |
| 4,618,035 | 10/1986 | Mao | 190/18 A |
| 4,679,670 | 7/1987 | Wickman | 190/18 A |
| 4,707,881 | 11/1987 | Van Hoye | 190/18 A |
| 4,759,431 | 7/1988 | King et al. | 190/18 A |
| 4,771,871 | 9/1988 | Lambracht | 190/18 A X |
| 4,838,396 | 6/1989 | Krenzel | 190/18 A |
| 4,852,705 | 8/1989 | Cowan, Jr. | 190/18 A |
| 4,995,487 | 2/1991 | Plath | 190/18 A |
| 5,005,845 | 4/1991 | Haueter, Jr. | 190/18 A X |
| 5,048,649 | 9/1991 | Carpenter et al. | 190/18 A |

FOREIGN PATENT DOCUMENTS

| | | | |
|---|---|---|---|
| 106906 | 5/1984 | European Pat. Off. | 190/18 A |
| 3302672 | 8/1984 | Fed. Rep. of Germany | 190/18 A |
| 3636064 | 4/1988 | Fed. Rep. of Germany | 190/115 |
| 961977 | 5/1950 | France | 190/18 A |
| 59346 | 5/1954 | France | 190/18 A |
| 2409720 | 7/1979 | France | 190/18 A |
| 2538229 | 6/1984 | France | 190/18 A |
| 487220 | 11/1953 | Italy | 190/18 A |
| 352234 | 7/1931 | United Kingdom | 190/18 A |
| 391224 | 4/1933 | United Kingdom | 190/18 A |
| 2022997 | 12/1979 | United Kingdom | 190/18 A |

*Primary Examiner*—Sue A. Weaver

*Attorney, Agent, or Firm*—Wood, Herron & Evans

[57] ABSTRACT

Luggage has a generally rectangular container. A vertical sheath is fixed to the inside of the container along an end wall. A rigid handle is slidably mounted in the sheath and when extended is pivotable to a forwardly-inclined attitude for pulling the luggage. A wheel is mounted on the bottom wall of the luggage and centered between the forward and rearward end walls. A pair of wheels are mounted on the bottom wall adjacent each end wall.

9 Claims, 10 Drawing Sheets

LUGGAGE WITH PULL HANDLE

CROSS REFERENCE TO RELATED APPLICATIONS

This application is a continuation-in-part of co-pending U.S. Pat. application Ser. No. 487,459, entitled "Luggage with Pull Handle" filed Mar. 2, 1990, now U.S. Pat. No. 5,048,649 and assigned to the assignee of this invention.

BACKGROUND OF THE INVENTION

This invention relates to luggage.

It is known to mount castered wheels on the bottom wall of luggage and to provide a flexible strap for attachment to the end wall. The user pulls on the strap and the luggage rolls along the ground, thereby relieving the user of physically carrying heavily loaded luggage.

The arrangement of luggage and flexible strap works, but is not completely satisfactory. The flexible strap must be removed when the luggage is checked in at an airport or very likely the strap will be lost. A place must be found for the removed strap.

The flexible strap and castered wheels provide less than complete control of the luggage. If the castered wheels are stiff, they do not center properly and the luggage wanders, that is, it does not move in a straight line behind a user. The luggage will fall, particularly when walking fast or running. Luggage cannot turn corners very well, particularly if the casters are stiff.

The luggage must trail the user. The user cannot have the luggage alongside and inch it forward with the strap while standing in line at a ticket counter.

Other prior art consists of the following:

1) Luggage having a retracting flexible strap in an end wall.

2) Luggage having, on an end wall, a short, rigid, pivotally mounted pull handle cooperating with a pair of wheels on the opposite end of the luggage. This permits one end of the luggage to be lifted off the ground and pulled.

3) Luggage having a flat rigid handle that telescopes into the center of the side of hard sided luggage. Wheels mounted on the corner of the luggage directly below the handle permit the luggage to be tilted forward and pulled on the two wheels by the extended telescoping handle. The telescoping handle does not pivot.

4) A truck for moving articles from place to place, the truck having a platform mounted on two centrally located wheels, the platform having castered wheels at its forward and rearward ends and a rigid handle is provided to pull the truck.

BRIEF SUMMARY OF THE INVENTION

An objective of the present invention has been to provide an improved wheel and pull structure for luggage that puts the user more completely in control.

Another objective of the invention has been to provide a permanently-attached telescoping rigid pull for luggage that improves the stability of the luggage, its maneuverability and control.

Another objective of the invention has been to provide a wheel system for luggage imparting significantly improved maneuverability to the luggage.

These objectives of the invention have been attained by providing a rigid handle that is permanently attached to the luggage. When inoperative, the rigid handle is preferably telescoped in a sheath that is attached inside the luggage to an end wall. When in operative position, the handle is extended out of the sheath.

The handle can be pulled to and frictionally retained in an intermediate position between retracted and fully-extended. In this position, the handle can be used by the user standing alongside the luggage to inch the luggage forward.

The luggage is supported on two major wheels that are centrally located on the bottom of the luggage, preferably in wheel wells recessed into the luggage side walls, and a minor end wheel at each end of the luggage. Preferably but not necessarily, the end wheels are above the side wheels when the bottom wall of the luggage is horizontal. With this wheel arrangement, the luggage can be rolled with a three-wheel support or can, for maneuverability, be spun on a central axis simply by revolving about the two major wheels with the minor wheels not touching the ground.

A rigid handle for use with soft-sided luggage has been disclosed in a co-pending application entitled luggage frame with pull handle having Serial No. 07/487,459 which is assigned to the assignee of the present application. The disclosure of that application is herein incorporated in its entirety by reference. The present invention is applicable to both hard sided and soft sided luggage.

Summarizing advantages of the rigid handle invention, the rigid handle connected directly to the luggage and pivotable forward when extended provides optimum control over the luggage. It does not have to be removed, for it telescopes within the luggage when not in use. When in intermediate position, the handle is used for inching along, as when standing in line at a ticket counter. It presents a narrow profile when wheeled through a crowd, as contrasted to the prior art telescoping handle luggage.

Summarizing the advantage of the improved wheel system, by providing major wheels centered on the luggage and castered wheels mounted on the ends, the maneuverability is vastly improved over prior wheel systems.

The combination of rigid handle and centered wheels provides vastly improved control over pulled luggage. No tilting and thus bearing the weight of the luggage is required.

The invention contemplates alternative embodiments employing various configurations of a center wheel, castered wheels and fixed end wheels.

BRIEF DESCRIPTION OF THE DRAWINGS

The objectives and features of the present invention will become more readily apparent from the following detailed description taken in conjunction with the accompanying drawings in which.

DETAILED DESCRIPTION OF THE INVENTION

Figure 1:
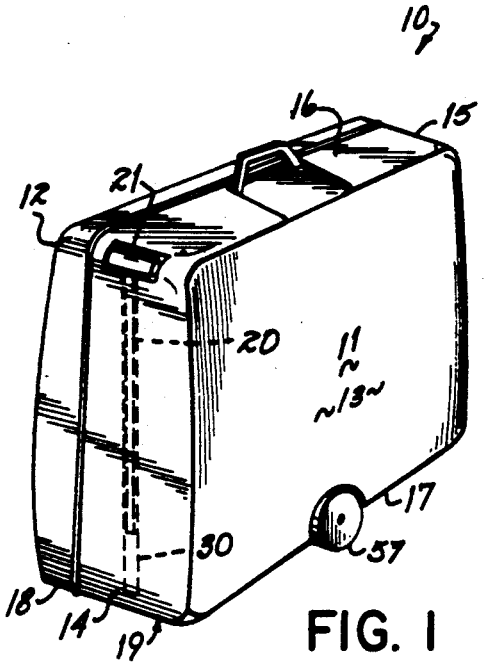
FIGS. 1–4 are perspective views illustrating the operation of the invention.

A hard-sided embodiment of the luggage is a container indicated at 10. It is generally known and is formed by a shell 11 enclosed by a lid 12. The shell has a side wall 13, a forward end wall 14, a rearward end wall 15, a top wall 16 and a bottom wall 17. The lid 12 forms a container side wall opposite side wall 13 and has a bottom wall 18 hinged to the shell bottom wall 17. Bottom walls 17 and 18 of the shell 11 and lid, respectively, form a container bottom wall 19.

Figure 4:
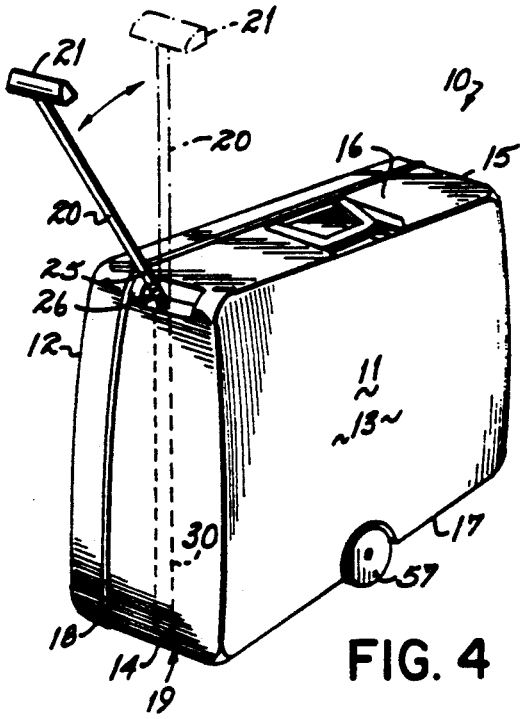

The forward wall 14 carries a rigid tubular handle 20 having a crossbar hand grip 21 at its upper end. The lower end 25 of the handle is connected by a helical spring 26 to the shell 11, the spring 26 permitting the handle to flex forward, as shown in FIG. 4.

Figure 2:
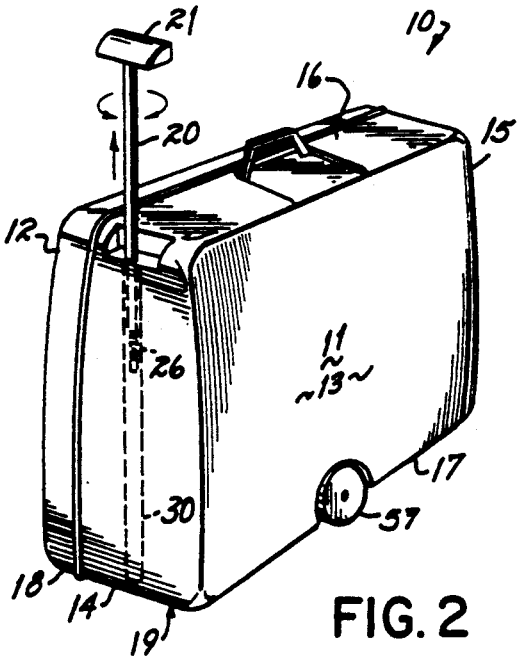
Figure 5:
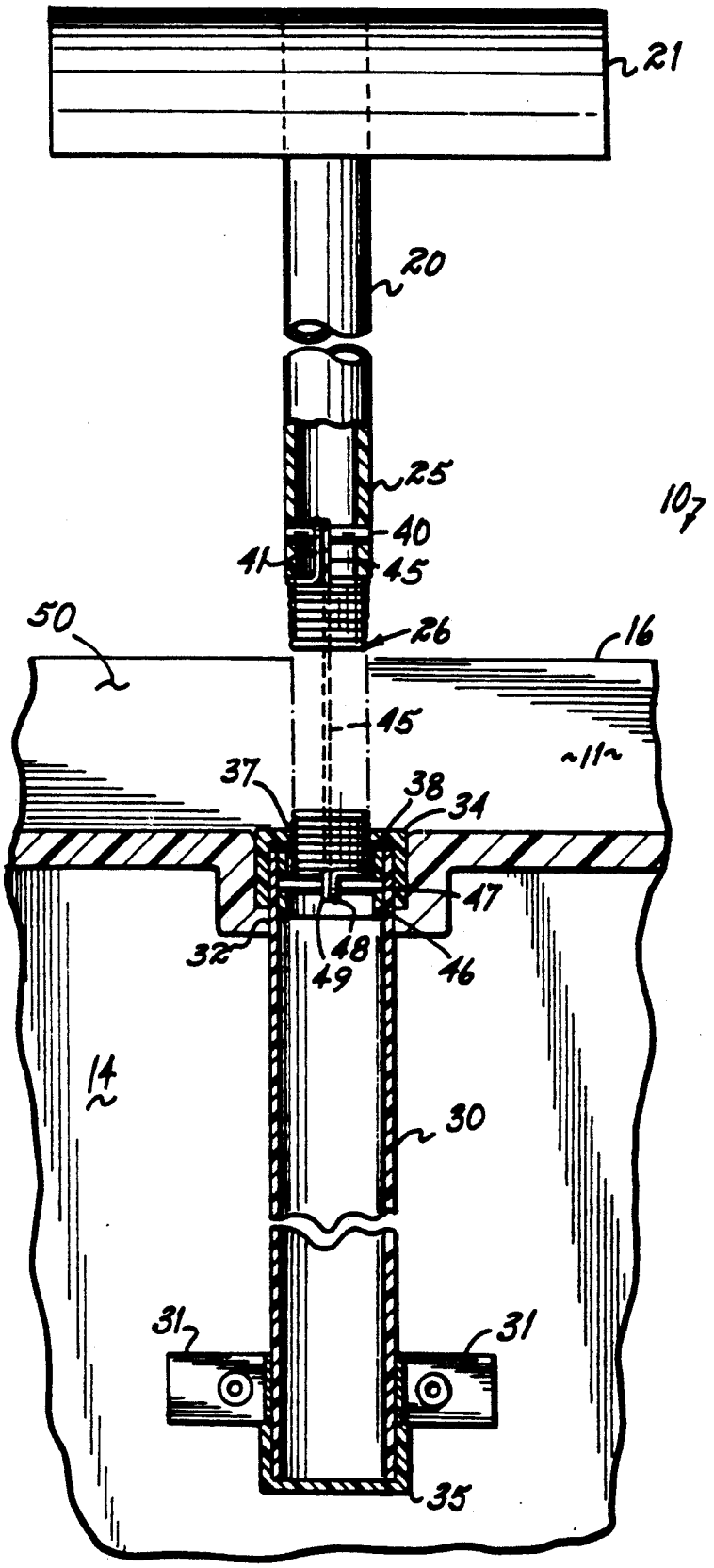
FIG. 5 is a cross-sectional view taken along lines 5—5 of FIG. 3.

The handle structure is best illustrated in FIG. 5. A sheath in the form of a tube 30 is fixed to the forward end wall 14 inside the shell 11. The tube 30 has an ID greater than the OD of handle 20, thereby permitting handle 20 to telescope within the tube 30. At its lower end, the tube 30 is snapped into a bracket 31. At its upper end, the tube is mounted in a hole 32 formed in the upper wall 16 of the shell. At its upper and lower ends, the tube 30 is enclosed by caps 34 and 35. The cap 34 at the upper end has an opening 37 through which the handle 20 passes. A friction sealing washer 38 is mounted between the cap 34 and the upper end of the tube 30 to form a seal between the handle and the shell and to provide friction for maintaining the handle in an intermediate position such as is shown in FIG. 2.

A pin 40 passes through the lower end of the handle 20. The upper end 41 of the spring 26 is connected to the pin 40. The upper end of a flexible strap 45 is also connected to the pin 40. A cylindrical stop 46 is slidable in the tube 30, but has too great a diameter to pass through the hole 37 in the cap 34 at the top of the tube. A pin 47 passes through the stop 46. The lower end 48 of the spring 26 is connected to the pin 47 and the lower end 49 of the strap 45 is connected to the pin. Thus, the engagement of the stop 46 with the washer 38 and cap 34 blocks the removal of the handle from the shell.

It is contemplated that connectors other than the spring 26 and strap 45 combination will be satisfactory. This will be demonstrated by reference to the embodiment of FIGS. 12 to 15.

Preferably, the shell has a recess 50 into which the crossbar handle grip 21 sits when the handle is fully retracted, as shown in FIG. 1.

Figure 6:
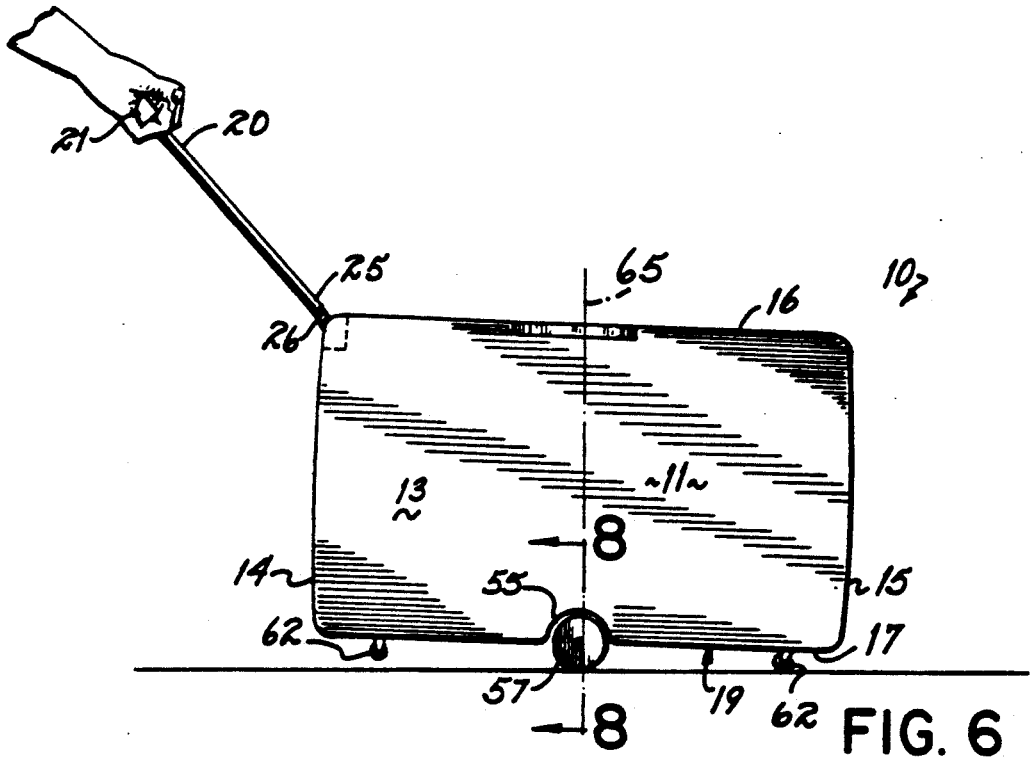
FIG. 6 is a side elevational view of the luggage.
Figure 7:
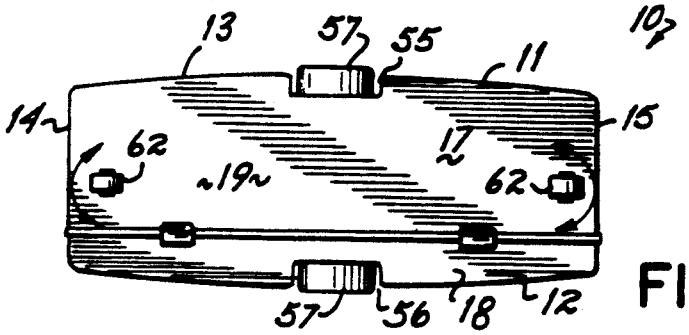
FIG. 7 is a bottom plan view of the luggage.
Figure 8:
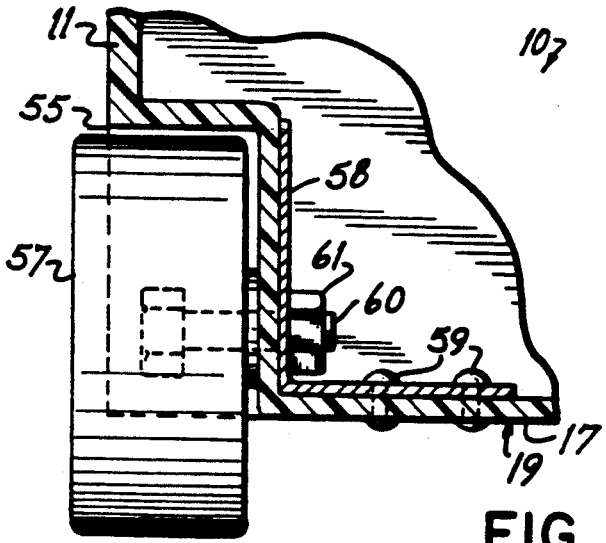
FIG. 8 is a cross-sectional view taken along lines 8—8 of FIG. 6.

The bottom wall 19 of the luggage is shown in FIGS. 7 and 8. The lid 12 and shell 11, respectively, are recessed at 55 and 56 creating wheel wells to receive major wheels 57. The major wheels are preferably at least about two inches in diameter. An L-shaped backing plate 58 is riveted at 59 to the bottom wall on the shell 11 and lid 12, respectively. An axle 60 is secured by a nut 61 to mount each major wheel 57 to the luggage. Minor castered wheels 62 (about one inch in diameter) are mounted on each end of the bottom wall 19. The lower surface of the castered wheels preferably is above the lower surface of the major wheels when the wall 19 is in a horizontal attitude. This arrangement permits only a three-wheel support, as illustrated in FIG. 6. It also permits the luggage to be spun on a vertical axis 65 passing through the axes of the major wheels 57 when neither minor wheel 62 touches the ground. This wheel design provides maximum maneuverability of the luggage. The luggage can be maneuvered satisfactorily with all four wheels at the same level.

In operation, the handle is normally retracted, as shown in FIG. 1. The handle can be raised to and frictionally held in an intermediate position, as shown in FIG. 2. This permits the user to stand alongside the luggage and push on the handle 20 to inch the luggage along while standing in an airport ticket line, for example.

Figure 3:
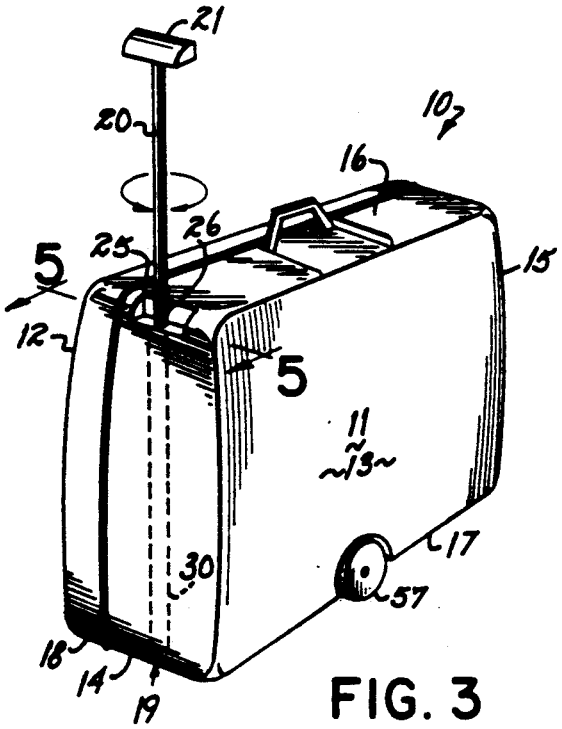

To position the handle in an attitude for pulling the luggage, the handle is first raised to a fully vertically-extended position shown in FIG. 3. In this position, the spring 26 and strap 45 project out of the shell. The handle can be put in a pulling attitude by leaning it forward and flexing the spring and the strap. When the handle is released, the spring urges the handle back to its vertical position so that it can be retracted into the shell simply by pushing down on it. The strap provides a tensile element that prevents the spring from extending and retracting with a springiness that would diminish control when the luggage is being pulled.

The invention has been described in connection with hard-sided luggage. It is to be understood that it is applicable to soft-sided luggage of the type depicted in FIGS. 9–11. Modifications have been made in order to accommodate the wheels and the telescoping pull handle.

Figure 10:
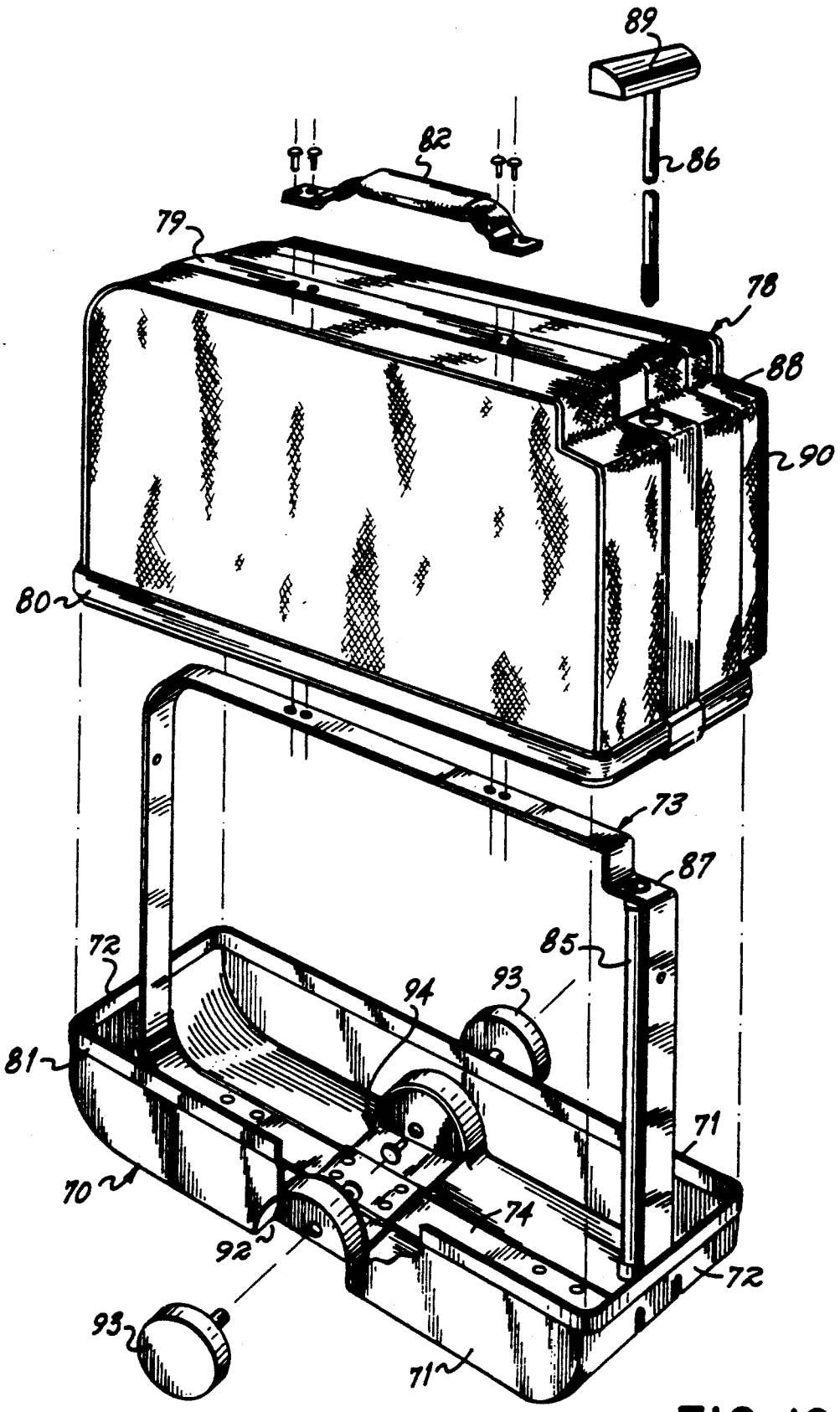
FIG. 10 is a disassembled perspective view of the embodiment of FIG. 9.

The luggage has a rigid bottom section 70. As best shown in FIG. 10, the bottom section 70 is basket-shaped and has side walls 71 and end walls 72.

Figure 11:
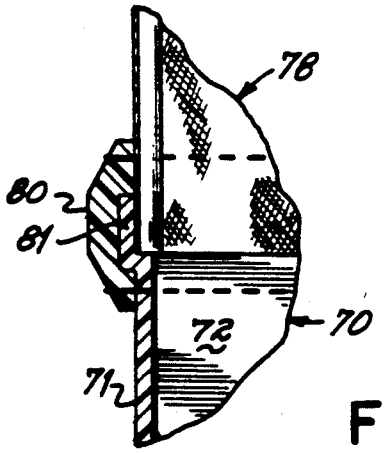
FIG. 11 is a cross-sectional view taken along lines 11—11 of FIG. 9.

A rigid frame 73 projects upwardly from the bottom section 70. The frame 73 is generally rectangularly-shaped and has a bottom strap 74 that is riveted to the bottom section 70. A soft-sided upper section 78 has a central inverted U-shaped rigid strap 79 by which the upper section is attached to the frame 73. A lower rim 80 is secured around the perimeter of the lower edge of the fabric and seats on a mating rim 81 forming the upper edge of the bottom section 70, the two rims being joined as by stitching, as shown in FIG. 11, to connect the soft-sided upper portion 78 to the bottom section 70. A handle 82 is riveted to the strap 79.

Figure 9:
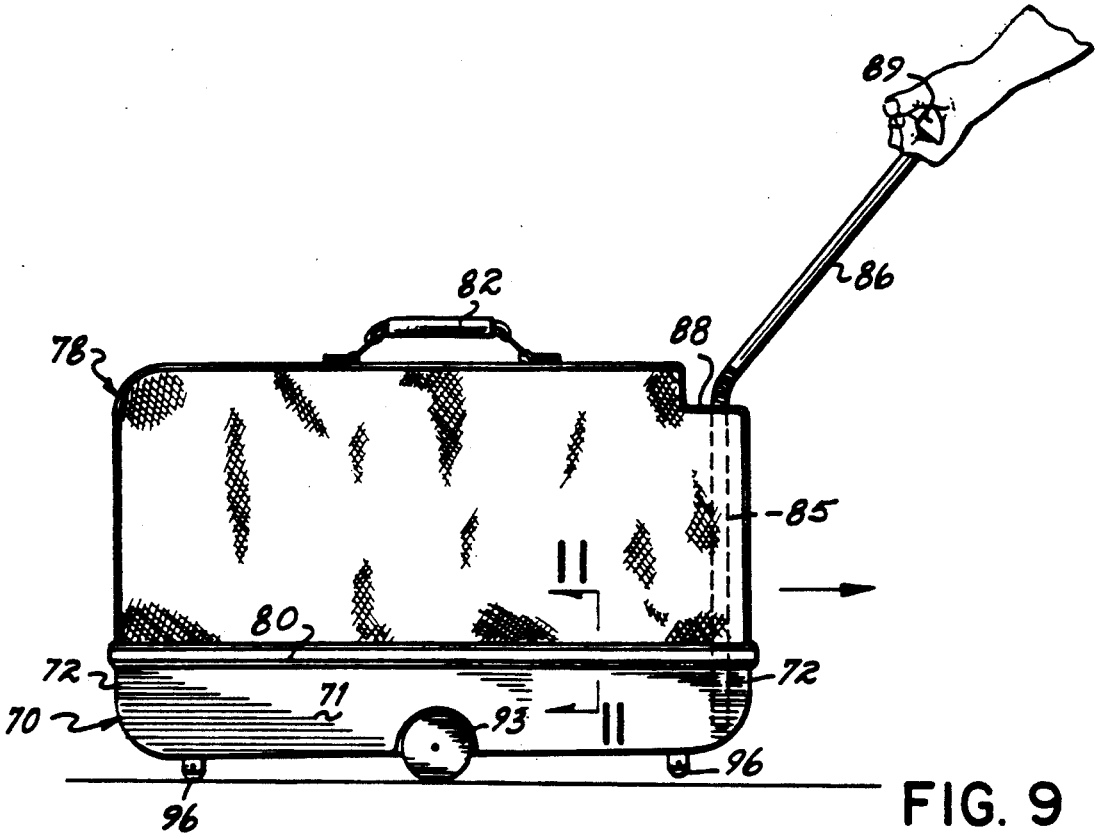
FIG. 9 is a side elevational view showing the invention with soft-sided luggage.

The frame 73 carries a tube 85 forming a sheath for a telescoping rigid handle 86. In this embodiment, the handle is formed as depicted in FIG. 5 but admits of variations which will permit the handle to telescope and to pivot forwardly, as shown in FIG. 9.

The frame 73 has a shoulder 87 to which the upper end of the tube 85 is connected. The soft-sided upper section 78 is also shouldered as at 88 to seat on the shoulder 87 and to form a recess for receiving the transverse hand grip 89 on the rigid handle 86. A soft-sided lid 90 is fastened to and forms a part of the upper section 78 by means of a stitched connection at its bottom edge and a zippered section around its perimeter, as is conventional.

The bottom section 70 has recesses 92 on each side forming wells for major wheels 93. Internally, the bottom section 70 has a U-shaped steel bracket 94 to which the major wheels 93 are rotatably mounted. Castered minor wheels 96 are mounted on the bottom section adjacent each end of the luggage (see FIG. 9).

The operation of the soft-sided luggage is identical to that of the hard-sided luggage.

In the alternative form of the invention as shown in FIGS. 12 to 16, the handle 100 is an elongated flat element having, at its upper end, a handle grip 101. The luggage 102 is recessed at a corner 103 to receive the handle grip 101.

The luggage has a shell 105 as in the embodiment shown in FIGS. 1 to 8. The shell has a bottom wall 106 recessed at 107 to receive large intermediate wheels 108.

Figure 16:
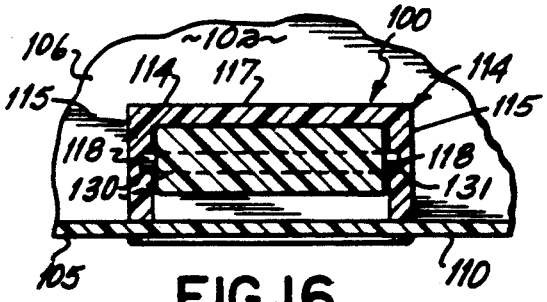
FIG. 16 is a cross-sectional view taken along line 16—16 of FIG. 13.
Figure 13:
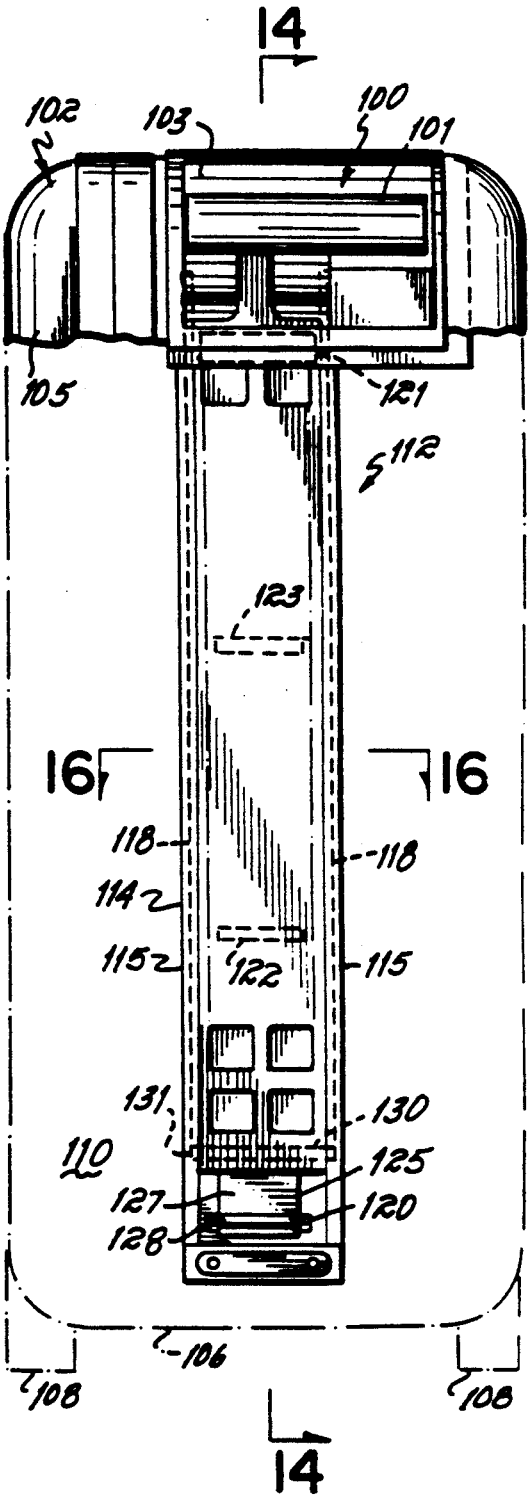
FIG. 13 is an elevational view of the telescoping handle structure.
Figure 14:
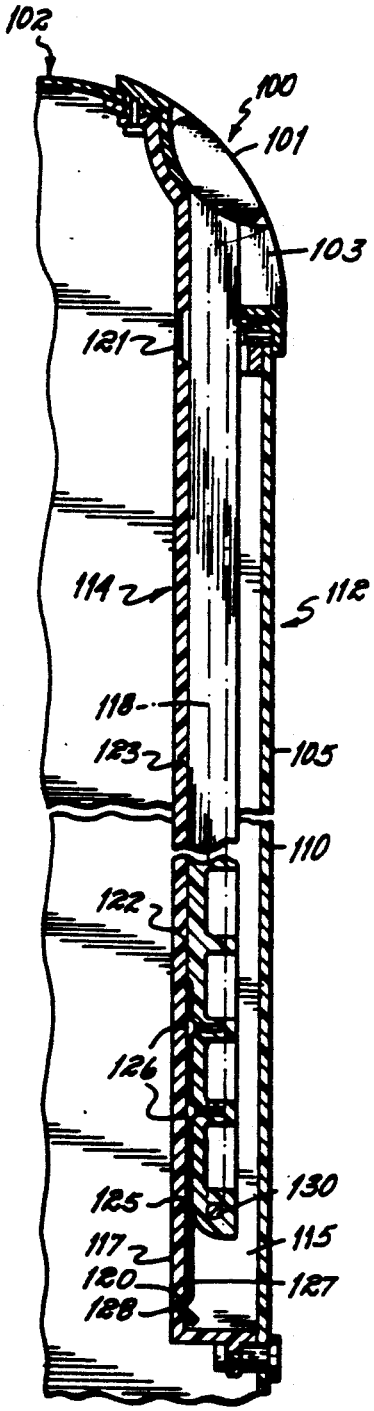
FIG. 14 is a cross-sectional view taken along lines 14—14 of FIG. 13.
Figure 15:
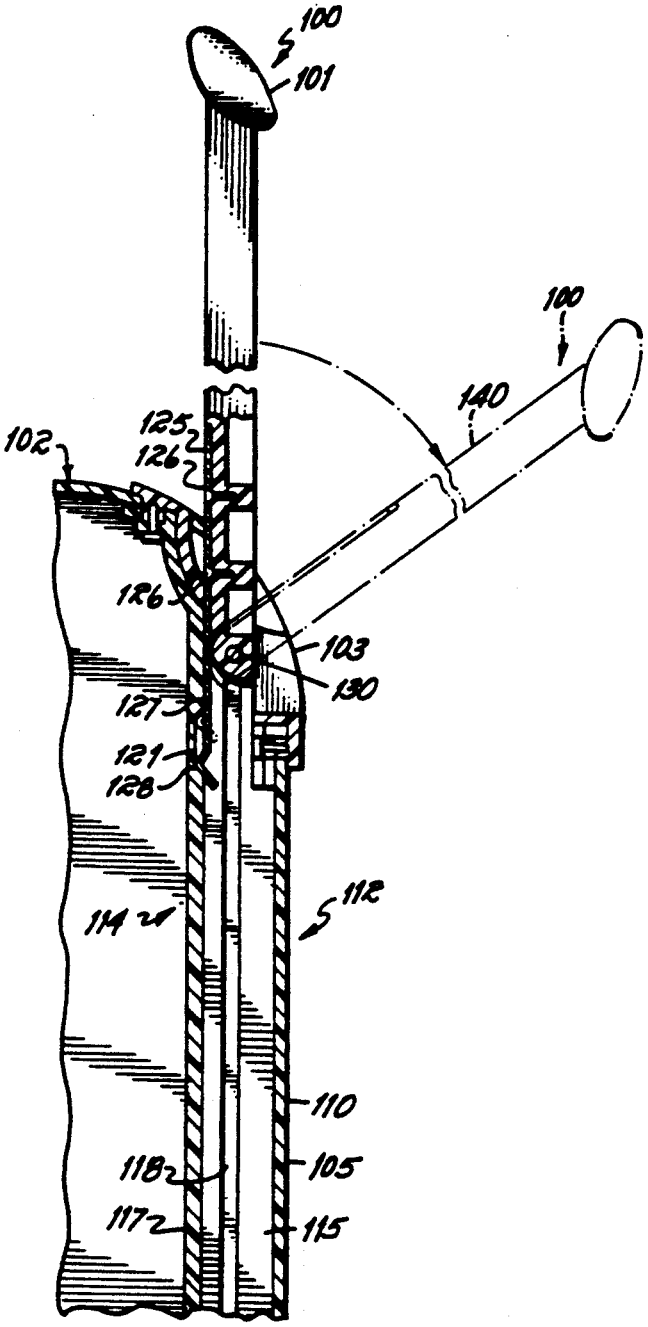
FIG. 15 is a view similar to that of FIG. 14 showing the handle in a vertical position and pivoted forward to an operative pulling position.

The shell has an end wall 110. A sheath 112 is formed in the end wall 110. As shown in FIGS. 14, 15, and 16, the sheath is formed in part by the shell end wall 110 and by a handle guide 114. The handle guide is U-shaped in cross-section (FIG. 16) and has a pair of side walls 115 and an inner wall 117. The side walls have vertical channels 118. The end wall has vertically spaced recesses at the lower end 120, the upper end 121, and intermediate recesses 122 and 123.

The pull handle 100 is flat and generally rectangular in cross-section. At its lower end, a leaf spring 125 is secured by screws 126 to the handle 100. The leaf spring has a free downwardly projecting portion 127 which has a detent 128 that projects toward the inner wall 117 of the handle guide 114.

The handle, at its lower end, has a transverse pin 130 having ends 131 projecting from the handle into the channels 118 of the handle guide. At the upper end of the channels 118 a stop 132 is formed, the stop being engageable by the transverse pin 130 to limit the upper extent of the movement handle.

In the operation of the embodiment of FIGS. 12 to 16, the handle is normally held in its telescoped position of FIG. 14 by the spring detent 128 being disposed in the recess 120 at the lower end of the sheath in which the handle slides.

When the handle is to be used as a pull, it is raised to its fullest extent, as shown in FIG. 15. There the detent 128 drops into the upper recess 121. Further, the transverse pin 130 engages the stop 132 at the upper end of the channel 118. The handle can be raised no further. In this raised position, the handle can be swung to a forward inclined position as shown at 140 so that the luggage can be pulled along the floor, rolling principally on the wheels 108. In pulling the handle forward as shown at 140, the spring 125 is bent, stressing it so that when the handle is released, it naturally will swing back to the vertical position shown in full lines in FIG. 15.

Figure 12:
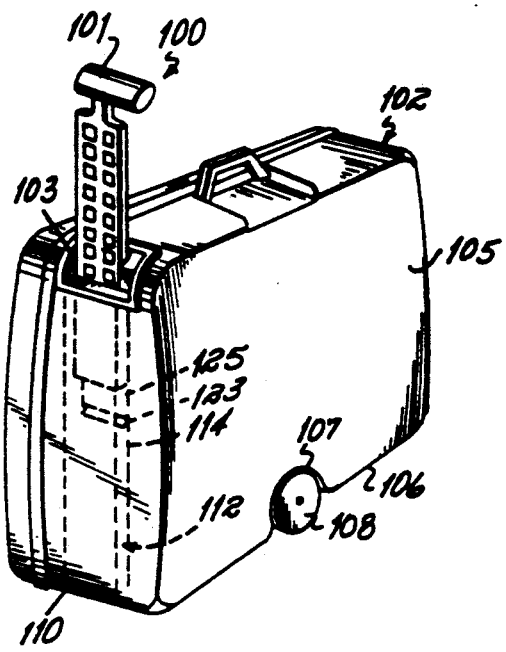
FIG. 12 is a perspective view of an alternative form of the invention.

The handle can be adjusted to an intermediate position and maintained there by the detent 128 dropping into either of the recesses 122 and 123. In that intermediate position, such as depicted in FIG. 12, the handle is in an ideal position for inching the luggage along as when standing in line at the airline ticket counter.

Other alternative embodiments are shown in FIGS. 17–21. These incorporate a single wheel as contrasted to the dual wheels of the prior embodiments. Using like numerals to identify like structural elements, each of the alternative embodiments has a container 10 with a rigid tubular handle 20 connected to the forward end wall 14. These embodiments may be used in both hard shell and soft sided luggage.

Figure 17:
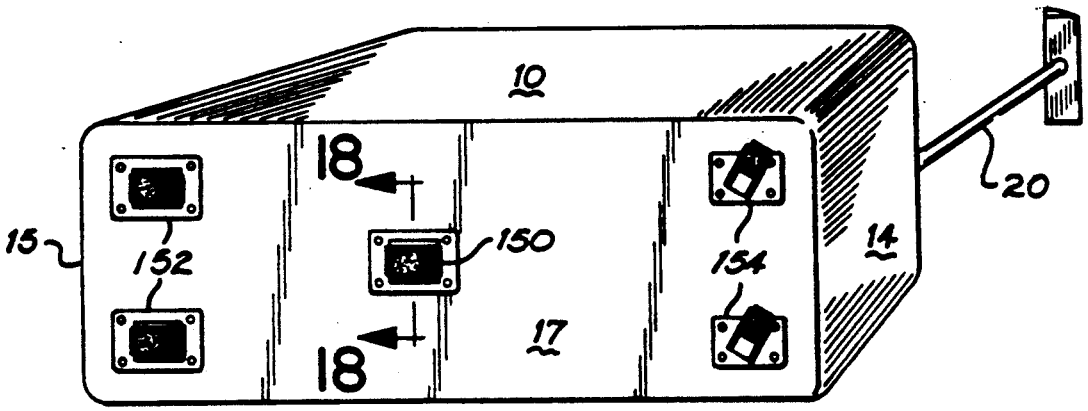
FIG. 17 is a diagrammatic bottom perspective of an alternative embodiment of the luggage.

The wheel arrangement shown in FIG. 17 includes a central wheel 150 mounted within a recessed wheel well and wheels 152 mounted near the rear end wall 15. These wheels are rotatably mounted about fixed axles that are transverse to the longitudinal axis of the luggage. Castered wheels 154 are mounted near the forward end of bottom wall 17. The fixed axle center wheel 150 and fixed axle rear wheels 152 prevent the luggage from "fishtailing" about the longitudinal axis of the luggage when being pulled by handle 20. Castered front wheels 154 permit more responsive turning for the stable luggage configuration provided by wheels 150, 152. In the alternative embodiment shown in FIG. 17, lower surface of center wheel 150 is preferably lower than the lower surface of the rear wheels 152 and forward wheels 154.

Figure 18:
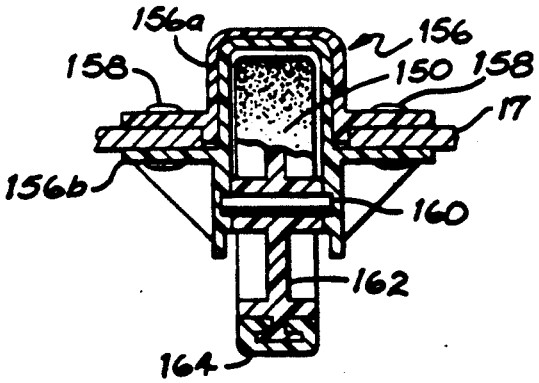
FIG. 18 is a cross-sectional view through the fixed wheel along line 18—18 of FIG. 17.

As shown in FIG. 18, the center wheel 150 is mounted to bottom wall 17 in a wheel cup. The floor 17 includes a centrally located die cut relief which receives a two-part molded plastic wheel cup 156 secured to the floor 17 by rivets 158. The two-part molded wheel cup includes an upper part 156*a* and lower part 156*b* which sandwich the floor 17 between them (FIG. 18). Center wheel 150 is mounted on a fixed axle 160 secured to the wheel cup 156 in a direction transverse to the longitudinal axis of the floor 17. The wheel 150 includes a plastic core 162 which is overmolded with a thermoplastic wheel 164 having a suitable hardness for rolling.

Figure 19:
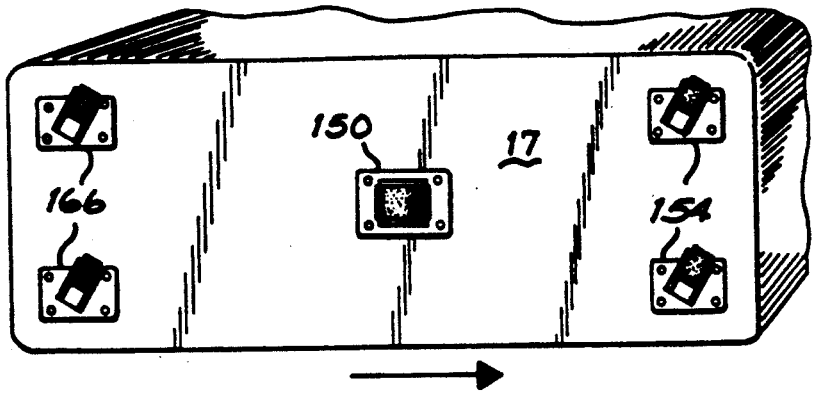
FIG. 19 is a fragmentary diagrammatic bottom perspective of another alternative embodiment of the luggage.

The alternative embodiment depicted in FIG. 19 is similar to that shown in FIG. 17 in that center wheel 150 is fixedly mounted within the recessed well as shown in FIG. 18. Castered wheels 154 are also mounted as those discussed with reference to FIG. 17 while the rear wheels 166 are also castered wheels. Center wheel 150 supports the luggage and keeps it on track in an unswerving fashion since it projects further from bottom wall 17 than the other wheels. The forward and rearward castered wheel pairs 154, 166 permit easy maneuverability of the luggage when it was not being pulled.

Figure 20:
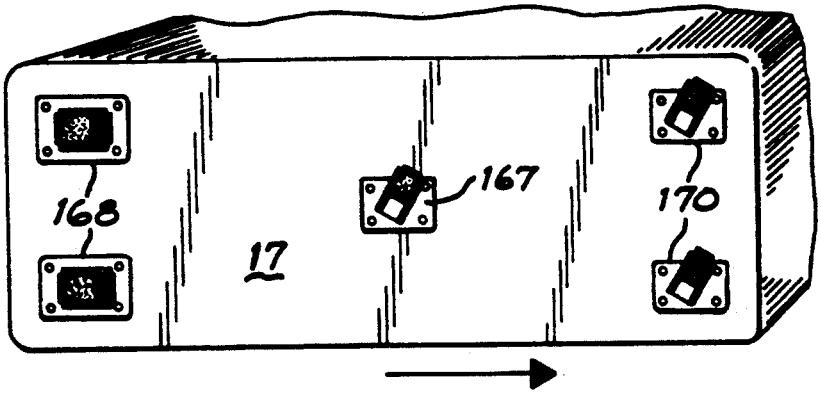
FIG. 20 is a fragmentary diagrammatic bottom perspective of another alternative embodiment of the luggage.

The wheel configuration of FIG. 20 shows a center castered wheel 167 which is mounted by rivets 169 or the like to bottom wall 17. Also mounted to bottom wall 17 in a manner similar to wheels 152 (FIG. 17) are rear wheels 168. Mounted at the forward end of bottom wall 17 are castered wheels 170. The castered wheels 170 and rear fixed axle wheels 168 have bottom surfaces which are higher than that of the center castered wheel 167. As the luggage is pulled along, the center wheel prevents "fishtailing" in the tracking of the luggage while castered wheels 170 are primarily used to turn the front end of the luggage more tightly when it is stationary.

Figure 21:
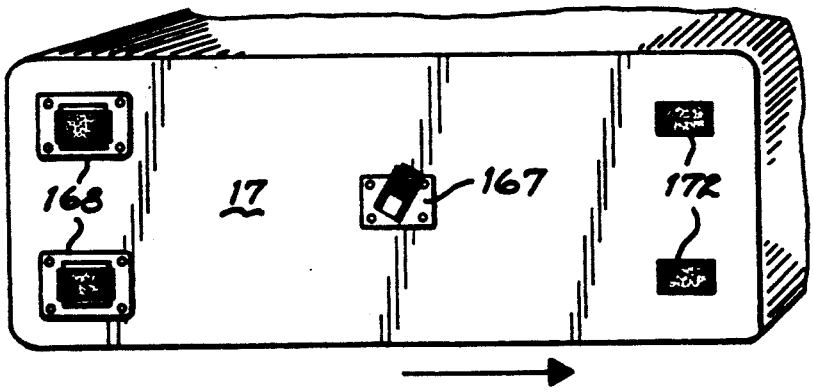
FIG. 21 is a fragmentary diagrammatic bottom perspective of another alternative embodiment of the luggage.

The alternative embodiment shown in FIG. 21 includes a center castered wheel 167 and rear wheels 168 like those shown previously in FIG. 20. Mounted near the forward end of bottom wall 17 are two bumpers 172 which are sized to project from bottom wall 17 less than center wheel 167. This sizing of bumpers 172 permits the forward end of the luggage to clear the floor as it is being pulled. Center wheel 167 prevents "fishtailing" as the luggage is pulled forward because the bottom surface of center castered wheel 167 is lower than the bottom surfaces of wheels 168 and bumpers 172.

Figure 22:
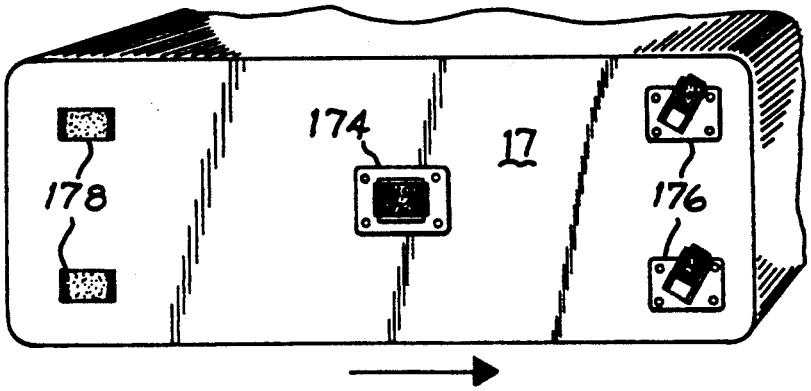
FIG. 22 is a fragmentary diagrammatic bottom perspective of another alternative embodiment of the luggage.

The alternative embodiment shown in FIG. 22 includes a center wheel 174 having a fixed transverse axle and a pair of castered wheels 176 mounted near the forward end of bottom wall 17. Center wheel 174 is mounted in the manner illustrated in FIG. 18 and its lower surface projects further from bottom wall 17 than do forward wheels 176. Mounted near the rearward end of bottom wall 17 are a pair of bumpers 178 which also project less from bottom wall 17 than center wheel 174.

Figure 23:
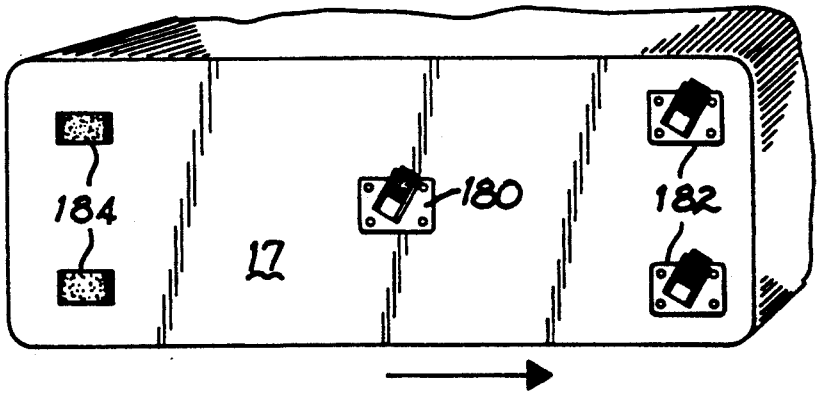
FIG. 23 is a fragmentary diagrammatic bottom perspective of another alternative embodiment of the luggage.

The alternative embodiment shown in FIG. 23 includes a center castered wheel 180 and a pair of forward castered wheels 182. Mounted near the rearward end of bottom wall 17 are bumpers 184. The lower surface of center wheel 180 projects further from bottom wall 17 than do the lower surfaces of front wheels 182 and rear bumpers 184.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. In luggage having a bottom wall, a top wall, opposed front and rear end walls and opposed side walls a wheel system comprising:

a major wheel rotatably mounted on a transverse axle adjacent said bottom wall and projecting below said bottom wall, said major wheel being centered longitudinally between said front and rear end walls, means for fixing said axle to said luggage, a pair of castered wheels mounted on said bottom wall adjacent at least one end wall, a pair of wheels mounted adjacent the other end wall, and elongated means attached to the luggage adjacent to the upper end of said front end wall for pulling said luggage at its rolls primarily on its major wheel, said major wheel, being on said fixed axle, maintaining the luggage tracking in the direction in which it is pulled while said wheels adjacent said end walls provide low friction ground support for the forward and rearward ends of said bottom wall.

2. The luggage of claim 1 wherein said pair of wheels mounted adjacent the other end wall are castered wheels.

3. The luggage of claim 1 wherein said pair of wheels mounted adjacent the other end wall are mounted on transverse axles and further comprising:

means for fixing said axles to said luggage adjacent said bottom wall.

4. In luggage having a bottom wall, a top wall, opposed front and rear end walls and opposed side walls a wheel system comprising:

a major wheel rotatably mounted on a transverse axle adjacent said bottom wall and projecting below said bottom wall, said major wheel being centered longitudinally between said front and rear end walls, means for fixing said axle to said luggage, a first pair of castered wheels mounted on said bottom wall adjacent at least one end wall, a second pair of castered wheels mounted adjacent the other end wall, said first and second wheel pairs projecting below said bottom wall less than said major wheel, and elongated means attached to the luggage adjacent to the upper end of said front end wall for pulling said luggage is it rolls primarily on its major wheel, said major wheel, being on said fixed axle, maintaining the luggage tracking in the direction in which it is pulled while said wheels adjacent said end walls provide low friction ground support for the forward and rearward ends of said bottom wall.

5. In luggage having a bottom wall, a top wall, opposed front and rear end walls and opposed side walls, a wheel system comprising:

a major, castered wheel mounted adjacent said bottom wall and projecting below said bottom wall, said major wheel being centered longitudinally between said front and rear end walls, means for fixing said wheel to said luggage, a pair of end wheels rotatably mounted on a transverse axle adjacent said rear end wall, means for fixing said axle to said luggage, a pair of castered end wheels mounted adjacent said front end wall, the lower surface of said major wheel being below the lower surface of said end wheels, and elongated means attached to the luggage adjacent to the upper end of said front end wall for pulling said luggage as it rolls primarily on said major castered wheel and partly on said fixed axle wheels.

6. In luggage having a bottom wall, a top wall, opposed front and rear end walls and opposed side walls, a wheel system comprising:

a major wheel mounted adjacent said bottom wall and projecting below said bottom wall, said major wheel being centered longitudinally between said front and rear end walls, means for fixing said wheel to said luggage, a pair of end wheels mounted adjacent said bottom wall near one of said front and rear end walls, means for fixing said pair of end wheels to said luggage, a pair of bumpers mounted adjacent the other said end wall, the lower surface of said major wheel being below the lower surface of said end wheels and bumpers, and elongated means attached to the luggage adjacent to the upper end of said front end wall for pulling said luggage as it rolls primarily on said center, castered wheel and partially on said end wheels.

7. The luggage of claim 6 wherein said major wheel is castered, said end wheels are rotatably mounted on a transverse axle adjacent said bottom wall near said front end wall, means for fixing said axle to said luggage, and said bumpers are mounted adjacent said rear wall.

8. The luggage of claim 6 wherein said major wheel is rotatably mounted on a transverse axle adjacent said bottom wall, means for fixing said axle to said luggage, said end wheels are castered wheels and are mounted near said front end wall, and said bumpers are mounted adjacent said rear end wall.

9. The luggage of claim 6 wherein said major wheel is castered, said end wheels are castered and mounted adjacent said front end wall, and said bumpers are mounted adjacent said rear end wall.

* * * * *